US005258754A

United States Patent [19]

Broderick et al.

[11] Patent Number: 5,258,754

[45] Date of Patent: Nov. 2, 1993

[54] CIRCUIT ARRAY FOR OPERATING A LIQUID-CRYSTAL DISPLAY (LCD)

[75] Inventors: Peter Broderick; Graham Stout, both of München, Fed. Rep. of Germany

[73] Assignee: EUROSIL electronic GmbH, Eching, Fed. Rep. of Germany

[21] Appl. No.: 533,592

[22] Filed: Jun. 5, 1990

[30] Foreign Application Priority Data

Jul. 21, 1989 [DE] Fed. Rep. of Germany ..... 3924061
Feb. 28, 1990 [DE] Fed. Rep. of Germany ..... 4006243

[51] Int. Cl.[5] ..... G09G 3/18
[52] U.S. Cl. ..... 345/51
[58] Field of Search ..... 340/765, 784, 811, 812, 340/700, 800

[56] References Cited

U.S. PATENT DOCUMENTS

| | | | |
|---|---|---|---|
| 3,780,523 | 12/1973 | Naito | 340/765 |
| 3,921,162 | 11/1975 | Fukai et al. | 340/784 |
| 4,027,305 | 5/1977 | Kishimoto | 340/765 |
| 4,127,851 | 11/1978 | Middel | 340/800 |
| 4,257,045 | 3/1981 | Miles | 340/765 |
| 4,264,963 | 4/1981 | Leach | 340/811 |
| 4,393,379 | 7/1983 | Berting et al. | 340/800 |
| 4,737,782 | 4/1988 | Fukuma et al. | 340/765 |

FOREIGN PATENT DOCUMENTS

| | | |
|---|---|---|
| 2939553 | 11/1982 | Fed. Rep. of Germany . |
| 3234782 | 4/1983 | Fed. Rep. of Germany . |
| 3508321 | 9/1986 | Fed. Rep. of Germany . |

OTHER PUBLICATIONS

"Programmable LC Controller/Drive," NEC Electronics (Europe) GmbH, NEC μPD 7225 (Mar., 1981), pp. 1–12.

"1.5V CMOS 4 bit Single Chip Microcomputer," e3101, eurosil (Oct., 1984), pp. 1–10.

IEE Daystar Nova Series LC Displays 3803; Nov. 1985; S. 1–12.

*Primary Examiner*—Jeffery Brier
*Attorney, Agent, or Firm*—Spencer, Frank & Schneider

[57] ABSTRACT

The invention relates to a circuit array for operating a liquid-crystal display in the time-division multiplexing mode, the display having at least one backplane and several segments. The circuit array includes a microprocessor having a first pulse generator, a shift register array storing data signals supplied to the circuit array, this shift register array having a number of stages corresponding to the number of segments, and driving stages which generate segment pulse sequences for the segments in accordance with the supplied data signals. In accordance with the invention, the microprocessor supplies the data signals to the shift register array via a first interface, the shift register array being designed as a cyclic shift register with each register point of the shift register array being clearly allocated to a segment. In addition, the microprocessor supplies control data, particularly data determining the time multiplexing rate, to a second interface having a decoder. The decoded control data is passed to a pulse generator that generates a pulse sequence corresponding to a backplane pulse sequence, excepting the voltage level. Finally, each driving stage is supplied with a pulse sequence in order to generate the segment pulse sequences corresponding to the contents of the register points of the cyclic shift register.

15 Claims, 4 Drawing Sheets

| MULIPLEX RATE | | LCD SEG.-ELECTRODE | LCD BACK ELECTRODE | R | SEG 1 | SEG 2 | SEG 3 | SEG 4 |
|---|---|---|---|---|---|---|---|---|
| | 2:1 | SEG2 a SEG1 f b g e c SEG3 d DP SEG4 | R1 R2 | 1<br>2<br>3<br>4 | a<br>b<br>x<br>x | f<br>g<br>x<br>x | e<br>c<br>x<br>x | d<br>DP<br>x<br>x |
| | 4:1 | a SEG 1 f b g e c SEG2 d DP | R1 R3 R2 R4 | 1<br>2<br>3<br>4 | a<br>c<br>b<br>DP | f<br>e<br>g<br>d | | |

CIRCUIT ARRAY FOR OPERATING A LIQUID-CRYSTAL DISPLAY (LCD)

BACKGROUND OF THE INVENTION

The invention relates to a circuit array with a microprocessor having a first pulse generator for operating a liquid-crystal display (LCD) using the time-division multiplexing method, said array having at least one backplane and several segments, each backplane being allocated a backplane pulse sequence, a segment pulse sequence being specified for every possible combination of picture points on a segment and all pulse sequences periodically having clock-timed intervals of corresponding length and number, with driving stages for the segments generating the segment pulse sequences depending on the data signals supplied to the circuit array, and with a shift register array storing the supplied data signals, this array having a number of stages corresponding to the number of segments.

A circuit array of this type is known from German patent DE-PS 29 39 553. Here, a liquid-crystal display LCD is controlled with backplane pulse sequences R1, R2, R3 and segment pulse sequences SA, . . . , SH, for which purpose pulse patterns corresponding to the pulse sequences are emitted from a read-only memory ROM, which is programmable if necessary. The read-only memory ROM is controlled by a circuit INFO, for example a data-processing unit, with which the information to be displayed by the liquid-crystal display LCD can be emitted depending on a transfer signal TO of the read-only memory ROM. The pulse patterns corresponding to the pulse sequences are compiled in the read-only memory ROM depending on the information to be displayed and transmitted by the circuit INFO, and by means of pulse signals of differing pulse length. The pulse pattern for the backplane pulses is emitted in parallel to a memory STR, "parallel", connected behind the read-only memory ROM and the pulse pattern for the segment pulses emitted in series to a shift register array, "serial", connected behind the read-only memory ROM. The two memories STR and STS have a number of memory cells for parallel supply of the pulses that corresponds to the number of backplanes or segments of all display points. The pulse signals of differing pulse length are supplied by a frequency divider FT which additionally supplies a transfer pulse TC to the memory STS connected behind the shift register array SR and to the memory STR, which in their turn control the liquid-crystal display LCD. The read-only memory ROM and the frequency divider FT are controlled with the pulses of a time-clock generator CL that in addition generates the shift pulse for the shift register array SR. The shift register array SR has a number of stages corresponding to the total number of segments present in the liquid-crystal display. The memory STS controlling the liquid-crystal display LCD operates not only as a memory circuit, but also as a voltage adjusting circuit, where the voltage of the signals to be emitted by the memory adapts to the requirements set by the liquid-crystal display LCD.

The generation of the pulse patterns causing the pulse sequences for the backplanes and the segments in a single control circuit common to all the display points does however have the drawback that only a certain configuration of a liquid-crystal display is feasible, for example a four-digit liquid-crystal display operated by a three-step multiplexing method, with each display point having three backplanes and three segments (see embodiment as per FIG. 4 of the above patent). It was therefore not possible to operate a liquid-crystal display with less than three backplanes and three segments with this circuit array, since decoding of the data signals transmitted by the circuit INFO—for example a data-processing device—to the read-only memory ROM as well as the composition of the pulse patterns corresponding to the backplane or segment pulse sequences in the read-only memory ROM is fixed by the hardware. Since the data-processing system controlling the read-only memory ROM, for example a microprocessor, must emit the information to be displayed by the liquid-crystal display in a form compatible for the read-only memory ROM, a different configuration of a liquid-crystal display could only be designed by changing the internal structure of the microprocessor and if necessary also the number of stages of the shift register and of the memories STR and STS. This would however represent an unacceptable expense, as a different microprocessor would have to be developed for each different configuration of liquid-crystal display. The flexibility of a circuit array of this type for controlling a liquid-crystal display is therefore considerably restricted by the connection of a read-only memory ROM, which performs at the same time the generation of the pulse patterns corresponding to the backplane or segment pulse sequences.

For example, the microcomputer LCD-III developed by Hitachi (data sheet "Hitachi microcomputer Databook 4-bit single-chip", September 1984, pages 273 to 298) for direct control of a liquid-crystal display offers the possibility of software selection of the multiplexing rate, with the pulse patterns corresponding to the backplane or segment pulse sequences being held in readiness in the main memory of the processor, in order to be read into a read-write memory RAM when the liquid-crystal display is operating in multiplex mode; from there they are shifted into a shift register and then read out in parallel into a memory whose number of memory locations corresponds to the number of segments. Finally, this data is supplied directly to the driving stages controlling the segments. A drawback here is that the control of the liquid-crystal display is shut down, i.e. the display goes out, when the microprocessor is stopped for power economy reasons. Also, the microprocessor is subjected to an unnecessarily high load, since the shift register has to be reloaded with data for every clock pulse.

SUMMARY OF THE INVENTION

The object of the invention is to provide a circuit array for operating a liquid-crystal display of the type mentioned at the outset, in which autonomous data holding is possible regardless of the operating condition of the microprocessor.

This object is attained in accordance with the invention by the microprocessor supplying the data signals to the shift register array via a first interface, by the shift register array storing the data signals being designed as a cyclic shift register, by each register point of the shift register array being clearly allocated to a segment, by the microprocessor supplying control data, particularly the data determining the time multiplexing rate, to a decoder via a second interface, by the decoder passing on the decoded control data to a pulse generator that generates a pulse sequence corresponding to the backplane pulse sequence excepting the level, and by each driving stage being supplied with the pulse sequence generated by the pulse generator in order to generate the segment pulse sequences corresponding to the contents of the register points of the shift register array.

The shift register array is therefore designed as a cyclic shift register in accordance with the invention. As a result, it is possible to circulate in the cyclic shift register display data not changing for a certain period, with the data for controlling the liquid-crystal display being supplied to the driving stages of the segments after each circulation.

In a particularly preferred embodiment of the invention, the data to be transferred for the first and second interface is transferred in consecutive clock steps of the clock frequency generated by the first pulse generator via a single data channel.

In a further advantageous embodiment of the invention, the information to be displayed is updated by only the contents of those register points being updated whose allocated segments are necessary for the information currently to be displayed, and by the data signals in the other register points being shifted through the cyclic shift register to their old positions. As a result, continual generation of segment pulse sequences for display data not to be updated can be dispensed with, so that the strain on the microcomputer can be reduced in power-saving fashion.

In addition, the microprocessor contains, in a further preferred embodiment of the invention, a second pulse generator whose clock frequency is lower than the clock frequency of the first pulse generator. In the "SLEEP" mode of the microprocessor, the first pulse generator is shut down, and the liquid-crystal display is kept in operation using the second pulse generator by retaining the data signals in the register points of the cyclic shift register and switching these in the rhythm of the clock frequency of the second pulse generator to the driving stages. In this rest position of the microprocessor, its power consumption is considerably reduced.

Finally, in a particularly preferred embodiment of the invention, a controlled voltage source is provided for generation of the voltage level building up the backplane and segment pulse sequences, said source supplying an output voltage compensating for the temperature dependence of the liquid-crystal display. Since, as a result, the voltage levels to be applied to the liquid-crystal display are temperature-compensated regardless of the fluctuations in the supply voltage and with regard to the temperature characteristics of the LCD, the contrast of the liquid-crystal display is kept constant in an advantageous manner.

BRIEF DESCRIPTION OF THE DRAWINGS

The circuit array in accordance with the invention for operating a liquid-crystal display is described in further detail below on the basis of an embodiment with reference to the drawings, in which.

Identical parts are given the same identification numbers in the drawings.

DESCRIPTION OF THE PREFERRED EMBODIMENT

Figures 1, 2:
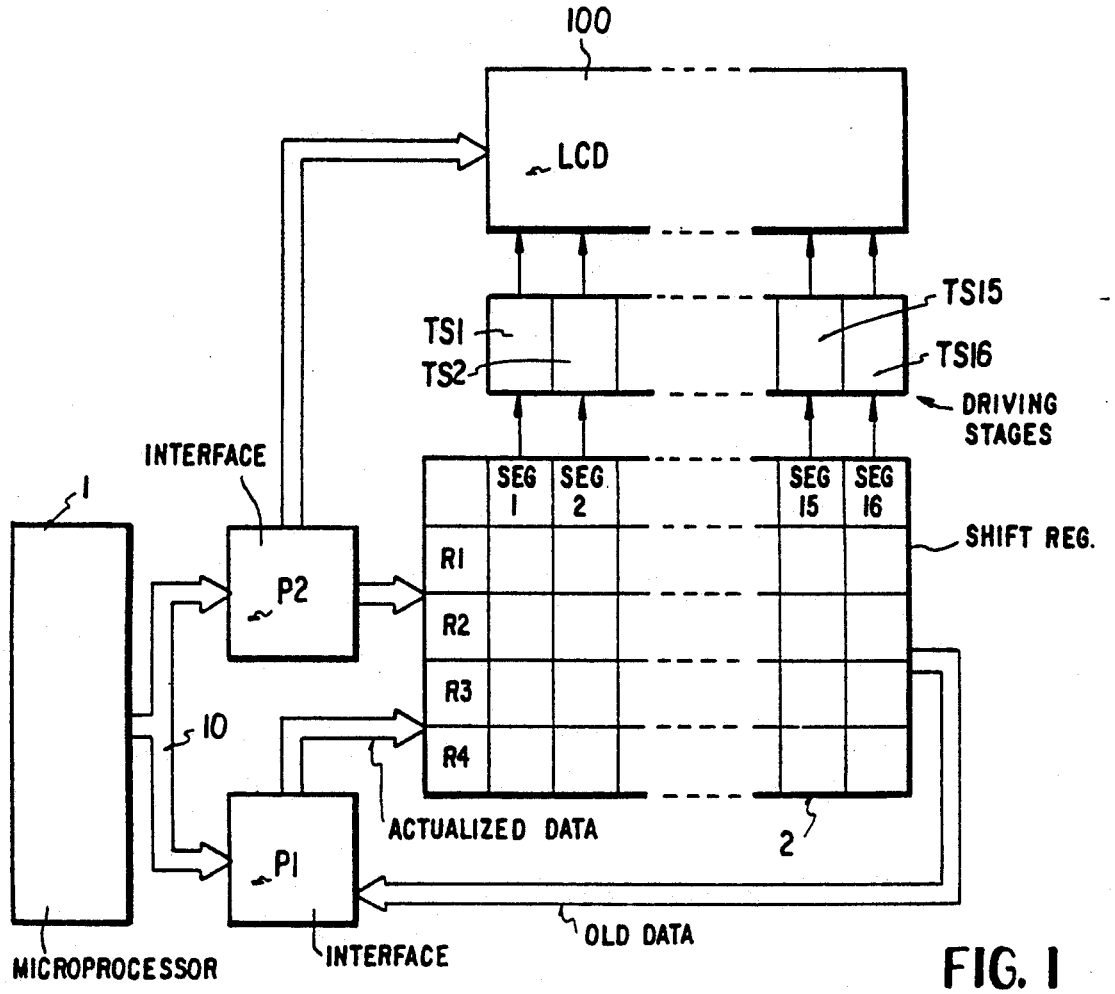
FIG. 1 shows a block wiring diagram of an embodiment in accordance with the invention of a circuit array for operating a liquid-crystal display.
FIG. 2 shows an embodiment of a layout of a single point of a liquid-crystal display and the use of the associated shift register points for controlling in 2:1 or 4:1 multiplex mode.

The block wiring diagram in FIG. 1 of an embodiment of the invention serves to make clear the principle of autonomous data holding in accordance with the invention, with a simple representation being selected for better understanding. Here, a first interface P1 or a second interface P2 receives from a microprocessor 1, via a data line 10, the data to be displayed in a liquid-crystal display (LCD) 100, or the control data. The liquid-crystal display 100 is made up of 16 segments and four backplanes. Accordingly, 16 driving stages TS1 to TS16 are necessary for controlling the 16 segments. These driving stages generate, depending on the pulse patterns supplied to them, the segment pulse sequences for controlling the segments. These pulse patterns corresponding to the segment pulse sequences are stored in a 4-bit shift register 2 with 16 stages. The shift register 2 here functions as a cyclic shift register, in which the data of the last register point for controlling the 16th segment can be shifted back into the first stage via a data line. If as a result the same information is always displayed after a certain period, the microprocessor 1 transmits an appropriate control signal "MASK" which causes the old data to be shifted back into the shift register 2 via the first interface P1. In addition, there are cases where the contents of each register point do not have to be altered in order to display new information. For this reason, the interface P1 updates only the contents of those register points whose allocated segments are necessary for the information currently to be displayed, while the data in the other register points is shifted through the shift register 2. The second interface P2 generates the backplane pulse patterns and supplies them both to the shift register 2 and to the backplanes of the liquid-crystal display 100.

In the following, the data filling of the shift register 2 as per FIG. 1 is explained in connection with the table in FIG. 2. Here, the table in FIG. 2 shows two examples of a layout of a display point for control by the multiplexing method with a multiplexing rate of 2:1 and 4:1. The first column shows the multiplexing rate, the second and third columns show the layouts of the segments and backplanes respectively, and the remaining columns show the allocation of the backplanes to the picture points of the appropriate segments. The 2:1 multiplexing method has two backplanes R1 and R2 and four segments SEG1, . . . , SEG4, each with two picture points (a, b), (f, g), (e, c) and (d, DP), whereas the 4:1 multiplexing method has four backplanes R1, . . . , R4 and two segments SEG1 and SEG2, each with four picture points (a, c, b, DP) and (f, e, g, d).

The segment data is transferred in series to the shift register 2 as nibbles, i.e. as four connected bit positions, as shown in FIG. 1. Each nibble therefore contains the data corresponding to the segment pulse sequences to be generated by each driving stage, with each bit being allocated to another backplane. With an 8-segment display operated in a 4:1 multiplexing method as per the table in FIG. 2, therefore, a maximum of 64 segments can be controlled using 16 driving stages. If for example the number "3" has to be displayed, the first nibble has the form "1110" and the second the form "0011". In the 2:1 multiplexing method, however, only the first two bit positions of a nibble are filled, as can also be seen from the table in FIG. 2. In this case, however, the bits are transferred double, thereby halving the backplane time period and doubling the effective pulse sequence frequency for the backplanes. The basic backplane pulse signals are therefore the same as in the 4:1 multiplexing method. It is therefore not necessary to specially generate backplane pulse forms in the 2:1 multiplexing method.

Figure 3:
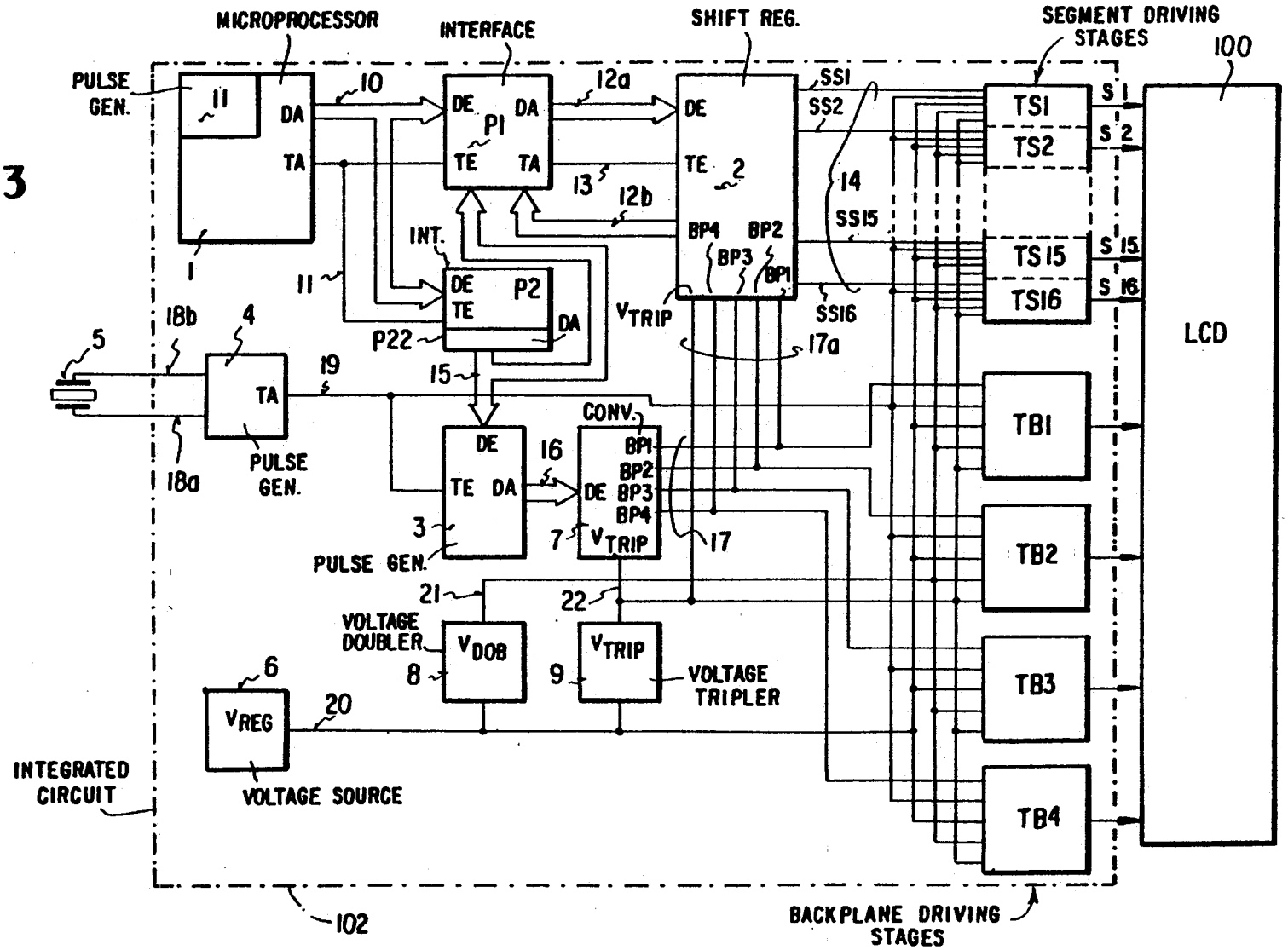
FIG. 3 shows a detailed block wiring diagram of the embodiment in accordance with the invention as per FIG. 1.

FIG. 3 shows the embodiment of the invention as per FIG. 1 in a detailed representation of a block wiring diagram. Here, the reference number 1 designates a 4-bit microprocessor containing a pulse generator 11 for generation of a pulse signal for example with a clock frequency of 1 MHz. The data output DA of this microprocessor 1 is conveyed via a bus line 10 to the data inputs DE of the first interface P1 and the second interface P2. The clock pulses are passed via the pulse output TA of the microprocessor 1 to the pulse inputs TE of these two interfaces P1 and P2 via a pulse line 11. Both the control data and the segment data proper are transferred using the bus line 10. The segment data are picked up by the first interface P1, while the control data, for example the multiplexing rate, can be picked up by the second interface P2. After appropriate processing of the segment data by the first interface P1, the processed data is supplied to a shift register 2 via the line 12*a*. In the same way, the clock pulses controlling the shift register 2 are generated by the first interface P1 and supplied via a pulse line 13 to the shift register 2. The shift register 2 is designed like that in FIG. 1, i.e. as a 16-stage 4-bit register operating as a cyclic shift register in which the data of the last stage is returned via a line 12*b* to the first interface P1 so that the latter can shift this data into the first register point when the appropriate control data is available. This control data is passed via a line 15 from the second interface P2 to the first interface P1. The second interface P2 contains a decoder P22 for decoding the control data, which is then supplied not only to the first interface P1 but also to a pulse generator 3. This pulse generator 3 generates, depending on the software-selected multiplexing rate, a pulse sequence corresponding to the backplane pulse sequence excepting the level. Adjustment to the level corresponding to the backplanes is carried out by the level converter 7 connected behind the pulse generator 3. The outputs supplying backplane pulse sequences BP1 to BP4 of this level converter 7 are connected to the driving stages TB1 to TB4 controlling the backplanes by 4 lines 17. The backplane pulse sequences BP1 to BP4 generated by the level converter 7 are supplied simultaneously to the shift register 2 by four further lines 17*a*. The data corresponding to the segment pulse sequences is stored in the register points of the shift register 2 and supplied to the driving stages TS1 to TS16 of the segments via 16 lines 14, designated SS1, . . . , SS16. These segment driving stages TS1 to TS16 and the driving stages TB1 to TB4 for the backplanes generate the segment pulse sequences and the backplane pulse sequences for direct control of the segments and backplanes respectively. These driving stages are supplied in the "SLEEP" mode of the microprocessor via the line 19 with a clock signal generated by a pulse generator 4 which at the same time contains a frequency divider stage. For this purpose, the pulse generator 4 is supplied, via the two lines 18*a* and 18*b*, by a crystal oscillator 5 oscillating at a frequency of 32 kHz. In addition, the driving stages TS1, . . . , TS16 and TB1, . . . , TB4 are supplied with a voltage $V_{reg}$ compensating for the temperature dependence of the liquid-crystal display. This compensated voltage $V_{reg}$ is generated by a voltage source 6, with this voltage $V_{reg}$ being supplied both to a voltage doubler circuit 8 and to a voltage tripler circuit 9. The doubler voltage $V_{dop}$ or tripler voltage $V_{trip}$ generated by these units 8 or 9 respectively is supplied via the line 21 or 22 respectively to the driving stages TS1 to TS16 or to TB1 to TB4 respectively. Furthermore, the tripler voltage $V_{trip}$ is also supplied to the level converter 7 and to the shift register 2 via one of the lines 17*a*.

Autonomous data holding already described in connection with FIG. 1 is also effected during the "SLEEP" mode of the microprocessor 1, in which its pulse generator 11 is switched off and the pulse generator 4 with the frequency divider stage assumes the supply of pulses to the circuit. The data stored in the register points of the shift register 2 is retained, i.e. data is not shifted into the shift register 2 nor is the data stored in shift register 2 (which operates as a cyclic shift register) pushed through during this time. The clock frequency of the second pulse generator 4 serves only to switch the data in the register points of shift register 2 to its outputs SS1 to SS16. If the microprocessor now switches after a data transfer to the "SLEEP" mode, the data to be displayed is retained on the liquid-crystal display 100, while the current consumption is reduced by the lower frequency.

The voltage levels for the backplane pulse sequences are independent of the supply voltage on account of the controlled voltage source 6. In addition, the result in conjunction with the temperature compensation is a constant contrast of the liquid-crystal display LCD.

The embodiment as per FIG. 3 is designed with the switching elements shown inside the dash-dotted line as an integrated circuit 102.

Figure 4:
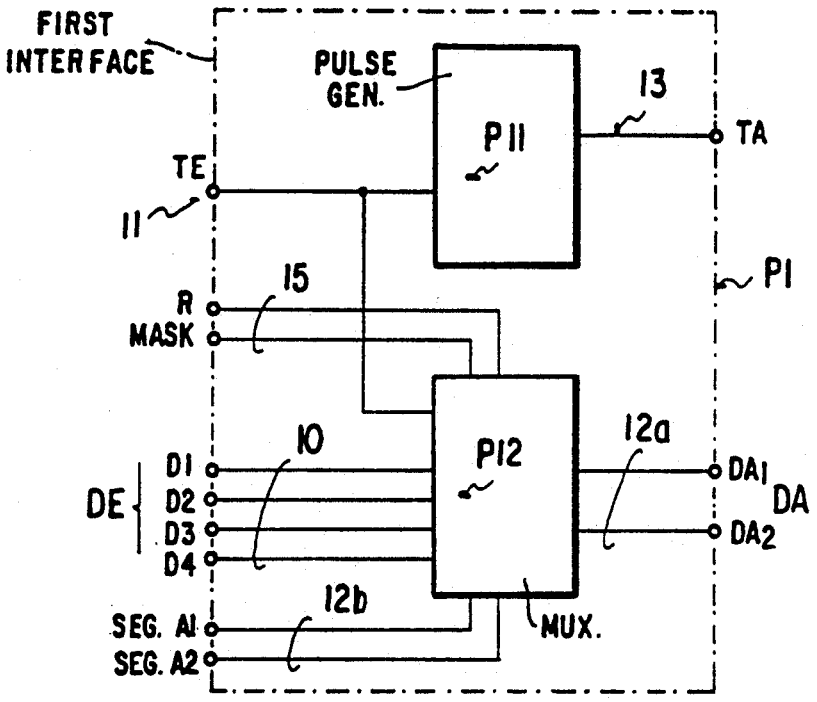
FIG. 4 shows a block wiring diagram of the first interface of the embodiment in accordance with the invention as per FIG. 3.

FIG. 4 is a diagram of the first interface P1, which is made up of a pulse generating unit P11 and a multiplexer P12. The pulse generating unit P11 generates the clock pulses for the shift register 2, being supplied to the latter via the line 13. The clock pulses of the microprocessor are supplied both to the pulse generating unit P11 and to the multiplexer P12 via the line 11. The multiplexer is supplied with both a reset pulse and the control signal "MASK" via the lines 15. The 4-bit data D1 to D4 applied to the input DE is supplied to the multiplexer P12 via four lines 10 and multiplexed on two lines 12*a*. At the output DA, therefore, two data signals DA1 and DA2 are available, which are supplied to the shift register 2 as per FIG. 6, with this shift register being physically designed as a 2-bit shift register. Finally, the multiplexer P12 is supplied via two lines 12*b* with the contents of the last stage of the shift register 2 as data signal S16A1 and S16A2.

Figure 5:
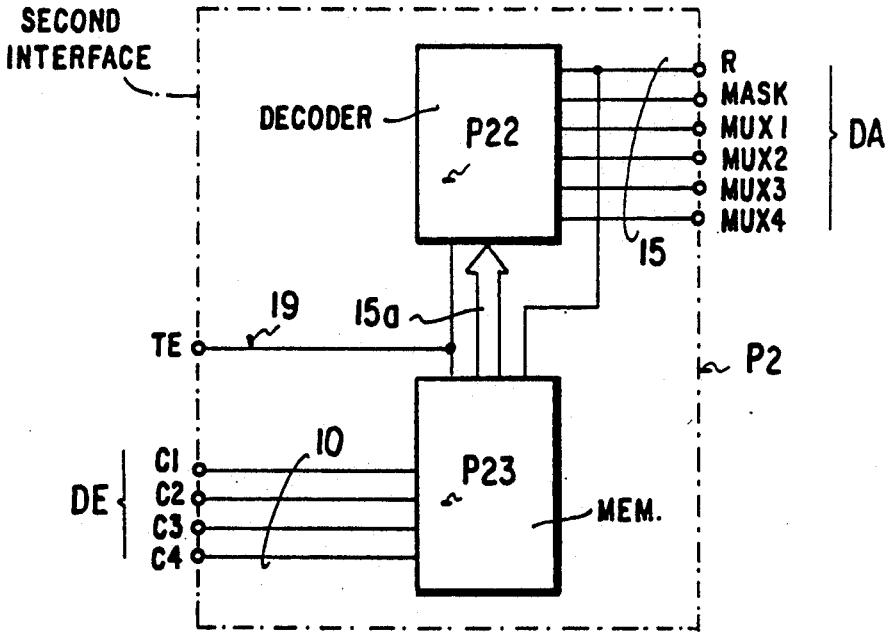
FIG. 5 shows a block wiring diagram of the second interface of the embodiment in accordance with the invention as per FIG. 3.

In FIG. 5, the second interface P2 as per FIG. 3 is shown in detail, where P22 and P23 designate a decoder and an input memory respectively. The data input DE of the input memory P23 is supplied via line 10 with the 4-bit control data C1 to C4. The input memory P23 can be made up of four D-flip-flops, for example. The input data is supplied via a line 15*a* to the decoder P22. In addition, the input memory P23 and the decoder P22 are supplied with a pulse via a pulse line 19. Finally, the decoded control data is available at output DA via the lines 15. Here, a reset signal R is transmitted via a first line and passed on to the input memory P23, the control signal "MASK" is generated at a second line, while control signals MUX1 to MUX4 are present at the remaining four lines, these control signals determining the mode for the liquid-crystal display LCD. This can be both direct control of the liquid-crystal display and control in the 2:1, 3:1 or 4:1 multiplexing method. The control signal "MASK" is transmitted when the contents of a register point of the shift register 2 do not have to be generated, but instead the old contents can be shifted back into the shift register 2.

Figure 6:
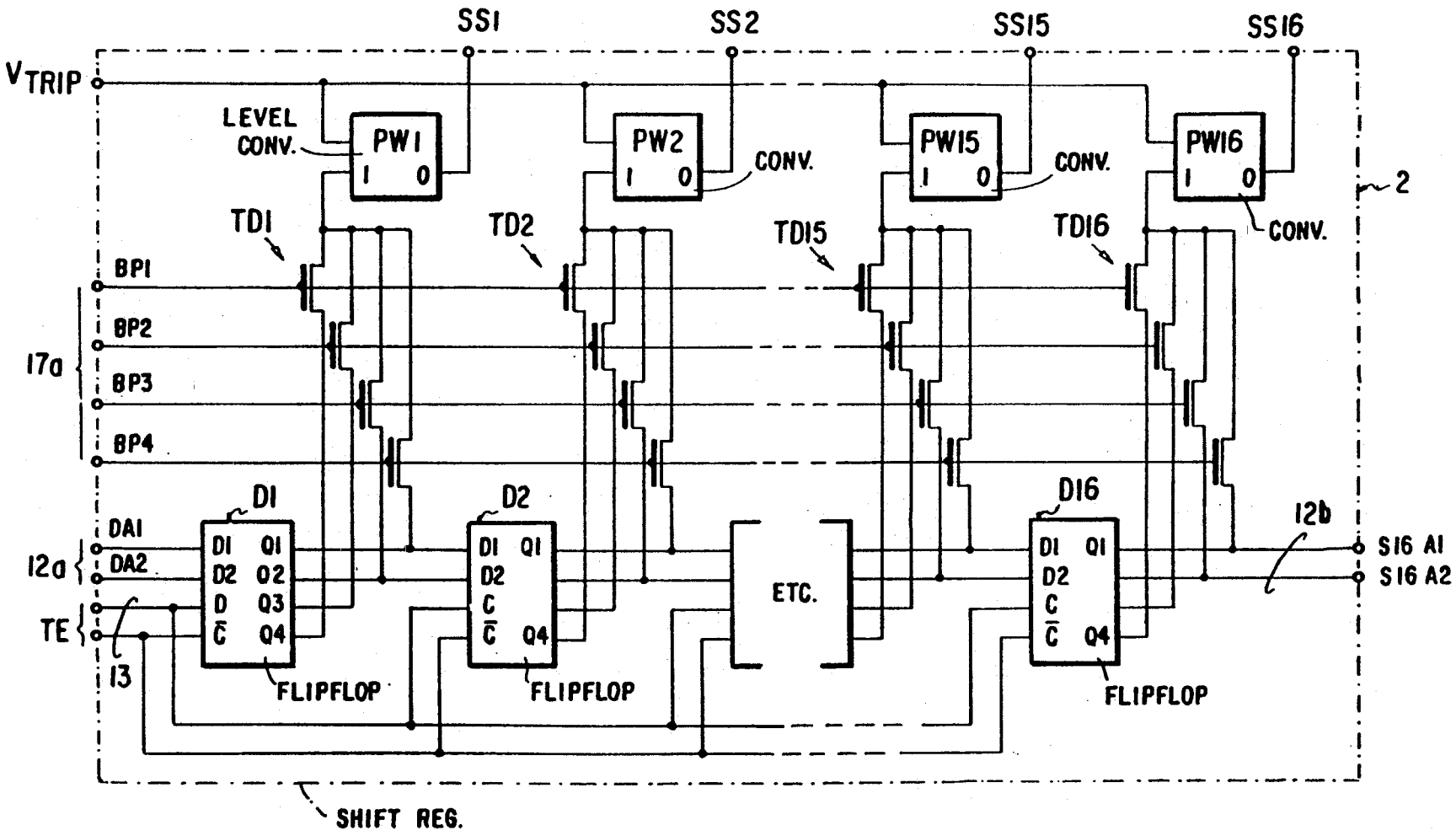
FIG. 6 shows a block wiring diagram of the shift register array of the embodiment in accordance with the invention as per FIG. 3.

FIG. 6 shows an embodiment of the shift register 2 in accordance with FIG. 3. This shift register 2 comprises double-D-flipflops D1 to D16 each with data inputs D1 and D2. The two data inputs of the first flipflop D1 are supplied via two lines 12*a* with the data signals DA1 and DA2 generated by the multiplexer. The pulse input TE of the flipflops is supplied with two clock signals inverse to one another via two lines 13. Each D-flipflop has four outputs Q1 to Q4, with the outputs Q1 and Q2 being connected to the two data inputs D1 and D2 of the following D-flipflop. The two outputs Q1 and Q2 of the last D-flipflop D16 supply, via the two lines 12*b*, the data contents S16A1 and S16A2 respectively to the last register point of the shift register 2 of interface P1 in accordance with FIG. 3, with the ring structure of the shift register 2 being achieved. The outputs Q1 to Q4 of the D-flipflops are each connected via a drain-source section of a field-effect transistor to the input I of a level converter PW. The four field-effect transistors belonging to each D-flipflop D1 to D16 are designated TD1 to TD16. The gate electrodes of the field-effect transistors belonging to the same output of a D-flip-flop of each transistor group TD1 to TD16 are connected, and supplied via four lines 17*a* with the backplane pulse sequences BP1 to BP4 generated with the level converter 7. The level converters PW1 to PW16 are additionally supplied with the tripler voltage $V_{trip}$. The pulse patterns corresponding to the segment pulse sequences can be picked up at the outputs 0 of these level converters and are supplied via the lines SS1 to SS16 to the driving stages TS1 to TS16.

With the embodiment in accordance with the invention as shown, therefore, it is possible to control up to 64 segments, with the segment data also being displayed in the rest position of the microprocessor ("SLEEP" mode). This mode permits a reduction in the current consumption and at the same time favourable storage of the segment data in a shift register designed as a cyclic shift register, so that as a result a memory, for example a read-write memory (RAM), is dispensed with. A decoding circuit, for example a programmable logic field (PLA), is also not necessary, since the segment data are decoded by software means in the microprocessor. Selection of the multiplexing rate is also by software means, so that the circuit can be adjusted to various layouts of liquid-crystal displays without alteration of the hardware.

In addition, a temperature-compensated control voltage for generating the voltage level for the backplane and segment pulse sequences ensures independence from the supply voltage, which may therefore fluctuate between 1.2 V and 5 V without incurring any loss of contrast for the liquid-crystal display.

Finally, the circuit array in accordance with the invention can be easily expanded as regards the segments to be controlled by increasing the number of steps in the shift register and if necessary adapting the software.

What is claimed is:

1. A circuit array for operating a liquid crystal display using the time-division multiplexing method, the liquid crystal display having a plurality of segment electrodes and a plurality of backplane electrodes, said circuit array comprising:

a microprocessor which emits data, the data emitted by the microprocessor including segment data;

a shift register array having a plurality of stages, each segment electrode of the liquid crystal display corresponding to a respective stage, each stage having a plurality of bit positions, each backplane electrode of the liquid crystal display corresponding to a respective bit position of the stages;

first interface circuit means for supplying segment data emitted by the microprocessor to the shift register;

a plurality of segment driving stages connected between the shift register array and the segment electrodes of the liquid crystal display;

second interface circuit means for generating backplane pulse sequences; and means for conveying the backplane pulse sequences to the backplane electrodes, the means for conveying including a plurality of backplane driving stages, wherein the shift register array is configured as a cyclic shift register, with the first interface circuit means being included into the cycle.

2. A circuit array according to claim 1, wherein the shift register array is connected to the means for conveying and receives the backplane pulse sequences, and wherein the shift register array comprises means, responsive to the backplane pulse sequences, for supplying the content of the bit positions of the shift register stages to the segment driver stages.

3. A circuit array according to claim 1, wherein the microprocessor comprises a first pulse generator, wherein the data emitted by the microprocessor additionally includes control data, wherein the segment data and control data are emitted by the microprocessor in consecutive clock steps of the clock frequency generated by the first pulse generator and are transferred respectively to the first and second interface circuit means via a single data channel, wherein the information to be displayed by the liquid crystal display is updated by changing only the contents of those stages of the shift register array corresponding to segment electrodes that are necessary for any new information that is to be displayed, and wherein the contents of the other stages of the shift register array are shifted through the shift register array to their old positions.

4. A circuit array according to claim 1, wherein the information to be displayed by the liquid crystal display is updated by changing only the contents of those stages of the shift register array corresponding to segment electrodes that are necessary for any new information that is to be displayed, and wherein the contents of the other stages of the shift register array are shifted through the shift register array to their old positions.

5. A circuit array according to claim 1, wherein the microprocessor comprises a first pulse generator with a first clock frequency, wherein the circuit array further comprises a second pulse generator with a second clock frequency that is lower than the first clock frequency, wherein the microprocessor has a "SLEEP" mode and, at the transition to the "SLEEP" mode of the microprocessor, the first pulse generator is shut down, and wherein the liquid crystal display is kept in operation during the "SLEEP" mode using the second pulse generator by retaining the content of the stages of the shift register array and switching these in the rhythm of the clock frequency of the second pulse generator to the segment driving stages.

6. A circuit array according to claim 1, wherein the microprocessor comprises a first pulse generator with a first clock frequency, wherein the circuit array further comprises a second pulse generator with a second clock frequency that is lower than the first clock frequency, wherein the data emitted by the microprocessor additionally includes control data, wherein the segment data and the control data are emitted by the microprocessor in consecutive clock steps of the first clock frequency and are transferred respectively to the first and second interface circuit means via a single data channel, wherein the microprocessor has a "SLEEP" mode and, at the transition to the "SLEEP" mode of the microprocessor, the first pulse generator is shut down, and wherein the liquid crystal display is kept in operation during the "SLEEP" mode using the second pulse generator by retaining the content of the stages of the shift register array and switching these in the rhythm of the clock frequency of the second pulse generator to the segment driving stages.

7. A circuit array according to claim 1, wherein the microprocessor comprises a first pulse generator with a first clock frequency, wherein the circuit array further comprises a second pulse generator with a second clock frequency that is lower than the first clock frequency, wherein the information to be displayed by the liquid crystal display is updated by changing only the contents of those stages of the shift register array corresponding to segment electrodes that are necessary for any new information that is to be displayed, wherein the contents of the other stages of the shift register array are shifted through the shift register array to their old positions, wherein the microprocessor has a "SLEEP" mode and, at the transition to the "SLEEP" mode of the microprocessor, the first pulse generator is shut down, and wherein the liquid crystal display is kept in operation during the "SLEEP" mode using the second pulse generator by retaining the content of the stages of the shift register array and switching these in the rhythm of the clock frequency of the second pulse generator to the segment driving stages.

8. A circuit array according to claim 1, wherein the microprocessor comprises a first pulse generator with a first clock frequency, wherein the circuit array further comprises a second pulse generator with a second clock frequency that is lower than the first clock frequency, wherein the date emitted by the microprocessor additionally includes control data, wherein the segment data and control data are emitted by the microprocessor in consecutive clock steps of the clock frequency generated by the first pulse generator and are transferred respectively to the first and second interface circuit means via a single data channel, wherein the information to be displayed by the liquid crystal display is updated by changing only the contents of those stages of the shift register array corresponding to segment electrodes that are necessary for any new information that is to be displayed, wherein the contents of the other stages of the shift register array are shifted through the shift register array to their old positions, wherein the microprocessor has a "SLEEP" mode and, at the transition to the "SLEEP" mode of the microprocessor, the first pulse generator is shut down, and wherein the liquid crystal display is kept in operation during the "SLEEP" mode using the second pulse generator by retaining the content of the stages of the shift register array and switching these in the rhythm of the clock frequency of the second pulse generator to the segment driving stages.

9. A circuit array according to claim 1, wherein the shift register array comprises means for emitting segment pulse sequences, and wherein the circuit array further comprises controlled voltage source means for generating voltage levels for building up the backplane and segment pulse sequences, the controlled voltage source means supplying an output voltage compensating for the temperature dependence of the liquid crystal display.

10. A circuit array according to claim 9, wherein the microprocessor comprises a first pulse generator, wherein the data emitted by the microprocessor additionally includes control data, and wherein the segment data and control data are emitted by the microprocessor in consecutive clock steps of the clock frequency generated by the first pulse generator and are transferred respectively to the first and second interface circuit means via a single data channel.

11. A circuit array according to claim 9, wherein the information to be displayed by the liquid crystal display is updated by changing only the contents of those stages of the shift register array corresponding to segment electrodes that are necessary for any new information that is to be displayed, and wherein the contents of the other stages of the shift register array are shifted through the shift register array to their old positions.

12. A circuit array according to claim 9, wherein the microprocessor comprises a first pulse generator with a first clock frequency, wherein the circuit array further comprises a second pulse generator with a second clock frequency that is lower than the first clock frequency, wherein the microprocessor has a "SLEEP" mode and, at the transition to the "SLEEP" mode of the microprocessor, the first pulse generator is shut down, wherein the liquid crystal display is kept in operation during the "SLEEP" mode using the second pulse generator by retaining the content of the stages of the shift register array and switching these in the rhythm of the clock frequency of the second pulse generator to the segment driving stages.

13. A circuit array according to claim 9, wherein the microprocessor comprises a first pulse generator, wherein the data emitted by the microprocessor additionally includes control data, wherein the segment data and control data are emitted by the microprocessor in consecutive clock steps of the clock frequency generated by the first pulse generator and are transferred respectively to the first and second interface circuit means via a single data channel, wherein the information to be displayed by the liquid crystal display is updated by changing only the contents of those stages of the shift register array corresponding to segment electrodes that are necessary for any new information that is to be displayed, and wherein the contents of the other stages of the shift register array are shifted through the shift register array to their old positions.

14. A circuit array according to claim 9, wherein the information to be displayed by the liquid crystal display is updated by changing only the contents of those stages of the shift register array corresponding to segment electrodes that are necessary for any new information that is to be displayed, wherein the contents of the other stages of the shift register array are shifted through the shift register array to their old positions, wherein the microprocessor comprises a first pulse generator with a first clock frequency, wherein the circuit array further comprises a second pulse generator with a second clock frequency that is lower than the first clock frequency, wherein the microprocessor has a "SLEEP" mode and, at the transition to the "SLEEP" mode of the microprocessor, the first pulse generator is shut down, and wherein the liquid crystal display is kept in operation during the "SLEEP" mode using the second pulse generator by retaining the content of the stages of the shift register array and switching these in the rhythm of the clock frequency of said second pulse generator to the segment driving stages.

15. A circuit array according to claim 14, wherein the data emitted by the microprocessor additionally includes control data, and wherein the segment data and control data are emitted by the microprocessor in consecutive clock steps of the clock frequency generated by the first pulse generator and are transferred respectively to the first and second interface circuit means via a single data channel.

* * * * *